US007057576B2

(12) United States Patent
Mukoyama

(10) Patent No.: US 7,057,576 B2
(45) Date of Patent: Jun. 6, 2006

(54) ANTENNA UNIT AND RADIO COMMUNICATION TERMINAL USING THIS ANTENNA UNIT

(75) Inventor: Atsushi Mukoyama, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/607,090

(22) Filed: Jun. 25, 2003

(65) Prior Publication Data

US 2004/0017330 A1 Jan. 29, 2004

(30) Foreign Application Priority Data

Jun. 28, 2002 (JP) ..... 2002-190156

(51) Int. Cl.
*H01Q 1/36* (2006.01)

(52) U.S. Cl. ..... 343/895

(58) Field of Classification Search ..... 343/895, 343/702; 361/728, 736, 737, 748
See application file for complete search history.

(56) References Cited

U.S. PATENT DOCUMENTS

| | | | | |
|---|---|---|---|---|
| 4,679,052 | A | 7/1987 | Ohe et al. | |
| 4,717,921 | A | 1/1988 | Ohe et al. | |
| 6,016,130 | A * | 1/2000 | Annamaa | 343/895 |
| 6,373,708 | B1 * | 4/2002 | Ando et al. | 361/737 |
| 6,559,801 | B1 * | 5/2003 | Davis | 343/702 |
| 6,586,931 | B1 * | 7/2003 | Taicher | 324/303 |
| 6,734,831 | B1 * | 5/2004 | Makino | 343/895 |
| 6,772,953 | B1 | 8/2004 | Iiyama et al. | |
| 2002/0017569 | A1 | 2/2002 | Iiyama et al. | |
| 2002/0130019 | A1 * | 9/2002 | Ninomiya et al. | 200/61.7 |
| 2002/0142795 | A1 * | 10/2002 | Imahori et al. | 455/550 |
| 2002/0153887 | A1 * | 10/2002 | Taicher | 324/303 |
| 2003/0120150 | A1 * | 6/2003 | Govari | 600/424 |

FOREIGN PATENT DOCUMENTS

| | | |
|---|---|---|
| EP | 0 102 091 | 3/1984 |
| EP | 0 747 989 | 12/1996 |
| EP | 0 755 091 | 1/1997 |
| EP | 1 193 794 | 2/2003 |
| GB | 2 322 236 | 8/1998 |
| GB | 2 334 382 | 8/1999 |
| GB | 2 385 992 | 9/2003 |
| JP | 9-36629 | 2/1997 |
| JP | 2001-216491 | 8/2001 |

OTHER PUBLICATIONS

AW Rudge, "The Handbook of Antenna Design" 1983: IEEE, pp. 842-844, vol. 2, Section 17.6.2.
United Kingdom Office Action in patent application GB0314457.3 dated Apr. 22, 2005.
Chinese Office Action in patent application 03148068.3 dated May 13, 2005.

* cited by examiner

*Primary Examiner*—Tan Ho
*Assistant Examiner*—Minh Dieu A
(74) *Attorney, Agent, or Firm*—Katten Muchin Rosenman LLP

(57) ABSTRACT

An antenna unit and a radio communication terminal using this antenna unit, in which the sensitivity in radio wave transmission and reception is increased, are provided. The antenna unit provides a coil of small diameter, a coil of large diameter, and a case that covers the coil of small diameter and the coil of large diameter. The case has one or plural opening parts within the range keeping the durability of the case. The radio communication terminal uses this antenna unit.

18 Claims, 4 Drawing Sheets

ANTENNA UNIT AND RADIO COMMUNICATION TERMINAL USING THIS ANTENNA UNIT

BACKGROUND OF THE INVENTION

The present invention relates to an antenna unit and a radio communication terminal such as a mobile communication terminal using this antenna unit, in particular, in which the sensitivity in radio wave transmission and reception is increased.

DESCRIPTION OF THE RELATED ART

An antenna unit, which is composed of coil shaped elements and a case covering the coil shaped elements, has been widely used in radio communication terminals such as mobile communication terminals.

However, at an conventional technology, the coil shaped elements have been fully covered with the case, consequently, the sensitivity in radio wave transmission and reception has been lowered by the case.

SUMMARY OF THE INVENTION

It is therefore an object of the present invention to provide an antenna unit and a radio communication terminal using this antenna unit, in which the sensitivity in radio wave transmission and reception is increased.

According to a first aspect of the present invention, for achieving the object mentioned above, there is provided an antenna unit. The antenna unit provides elements having a coil shape, and a case for covering the elements having the coil shape. And the case has one or plural opening parts within the range keeping the durability of the body of the case.

According to a second aspect of the present invention, in the first aspect, at least one of the plural opening parts is formed in the case at the position near the part where a current flowing in the elements is large.

According to a third aspect of the present invention, in the first aspect, the elements are connected in parallel, and at least one of the opening parts is formed at the position near the part where the elements are jointed.

According to a fourth aspect of the present invention, in the first aspect, at least one of the opening parts is formed at the position near the part where a power supply point to the elements is formed.

According to a fifth aspect of the present invention, in the first aspect, a door is formed at the position of each of the plural opening parts, and the door is opened when it is required.

According to a sixth aspect of the present invention, in the first aspect, the case is made of a resin.

According to a seventh aspect of the present invention, for achieving the object mentioned above, there is provided a radio communication terminal. The radio communication terminal provides an antenna unit. And the antenna unit provides elements having a coil shape, and a case for covering the elements having the coil shape. And the case has one or plural opening parts within the range keeping the durability of the body of the case.

According to an eighth aspect of the present invention, in the seventh aspect, at least one of the plural opening parts is formed in the case at the position near the part where a current flowing in the elements is large.

According to a ninth aspect of the present invention, in the seventh aspect, the elements are connected in parallel, and at least one of the opening parts is formed at the position near the part where the elements are jointed.

According to a tenth aspect of the present invention, in the seventh aspect, at least one of the opening parts is formed at the position near the part where a power supply point to the elements is formed.

According to an eleventh aspect of the present invention, in the seventh aspect, a door is formed at the position of each of the plural opening parts, and the door is opened when it is required.

According to a twelfth aspect of the present invention, in the seventh aspect, the case is made of a resin.

BRIEF DESCRIPTION OF THE DRAWINGS

The objects and features of the present invention will become more apparent from the consideration of the following detailed description taken in conjunction with the accompanying drawings in which.

DESCRIPTION OF THE PREFERRED EMBODIMENTS

Figure 1:
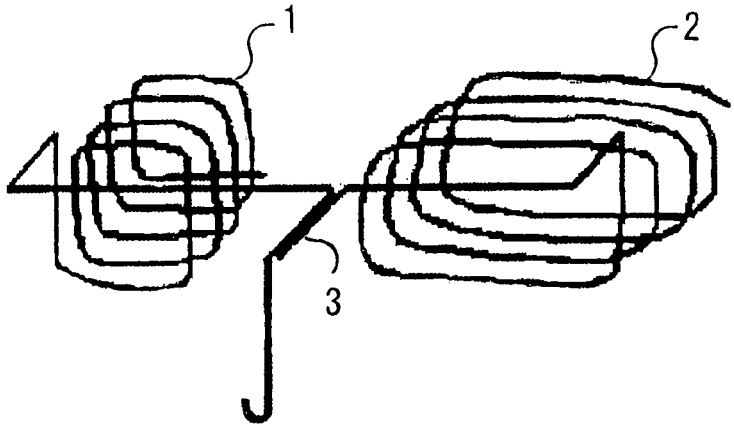
FIG. 1 is a diagram showing a structure of coils in an antenna unit at a first embodiment of the present invention.

Referring now to the drawings, embodiments of the present invention are explained in detail.

First, a first embodiment of the present invention is explained. FIG. 1 is a diagram showing a structure of coils in an antenna unit at the first embodiment of the present invention. As shown in FIG. 1, the coils are composed of a coil of small diameter 1 and a coil of large diameter 2, in which the resonant frequencies are different from each other. And the coil of small diameter 1 and the coil of large diameter 2 are connected in parallel at a joint 3. And the antenna unit corresponds to multi-band communication.

Figure 2:
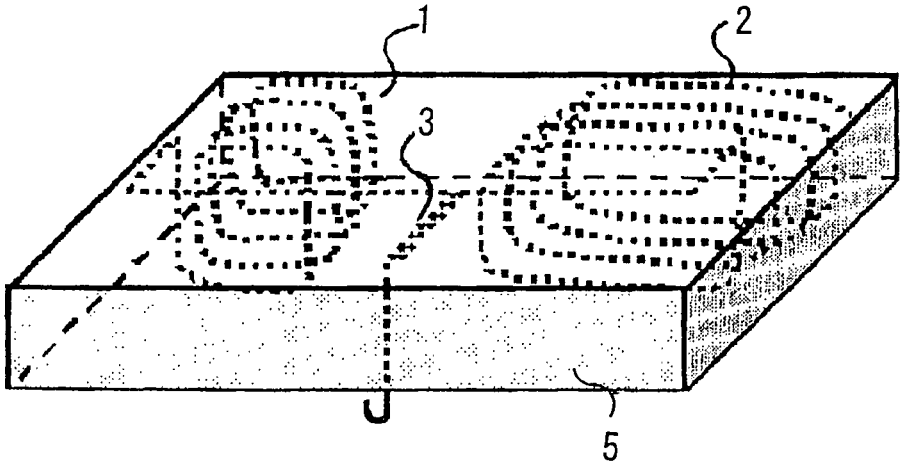
FIG. 2 is a perspective view of the antenna unit before forming opening parts at the first embodiment of the present invention.

FIG. 2 is a perspective view of the antenna unit before forming opening parts at the first embodiment of the present invention. As shown in FIG. 2, the coil of small diameter 1 and the coil of large diameter 2, which were connected at the joint 3, were covered with a case 5. The case 5 is made of a copolymer resin such as an ABC (acrylonitrile-butadiene-styrene) resin.

Figure 3:
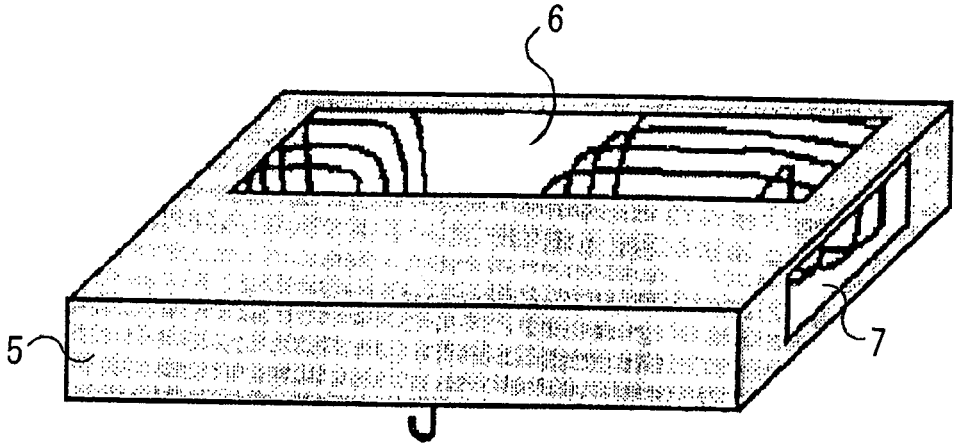
FIG. 3 is a perspective view of the antenna unit at the first embodiment of the present invention.

FIG. 3 is a perspective view of the antenna unit at the first embodiment of the present invention. As shown in FIG. 3, the case 5 has plural opening parts 6 and 7, within the range keeping the durability of the case 5. At the positions near the opening parts 6 and 7, the quantity of radio waves inputting to the coil of small diameter 1 and the coil of large diameter 2 becomes large, and also the quantity of radio waves outputting from the coil of small diameter 1 and the coil of large diameter 2 becomes large because of the opening parts 6 and 7. Therefore, by this structure, the sensitivity in radio wave transmission and reception is increased, and high gain can be obtained.

In FIG. 3, the positions of the opening parts 6 and 7 are examples, and are not limited to the positions shown in FIG. 3. The positions of the opening parts 6 and 7 are decided at any positions within the range keeping the durability of the case 5. Further, the number of the opening parts is not limited to two, and one opening part or three or more opening parts can be formed within the range keeping the durability of the case 5. As for the size of each of the opening parts 6 and 7, their width and length range from, for example, 3 to 5 mm.

Figure 4:
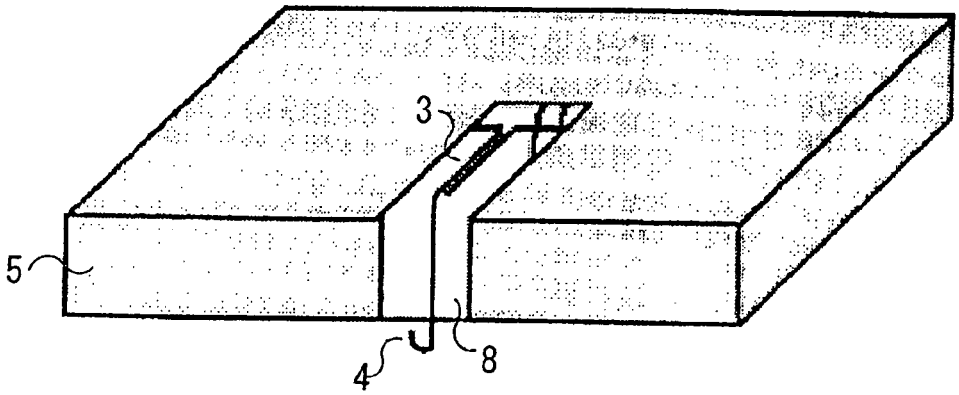
FIG. 4 is a perspective view of an antenna unit at a second embodiment of the present invention.

Next, a second embodiment of the present invention is explained. FIG. 4 is a perspective view of an antenna unit at the second embodiment of the present invention. At the second embodiment of the present invention, the structures of the coil of small diameter 1, the coil of large diameter 2, the joint 3, and the case 5 are the same as those at the first embodiment, therefore the same explanation is omitted. However, the position and the number of the opening part are different from those at the first embodiment.

As shown in FIG. 4, at the second embodiment, an opening part 8 is formed at the position near the part that the joint 3 is covered with the case 5. The part, where the joint 3 is covered with the case 5, is the position where currents of the coil of small diameter 1 and the coil of large diameter 2 flow largely.

The position where the currents flow largely is the position where the quantity of radio waves inputting to the coil of small diameter 1 and the coil of large diameter 2 is large, and also the quantity of radio waves outputting from the coil of small diameter 1 and the coil of large diameter 2 is large. Therefore, in order to increase the sensitivity in radio wave transmission and reception, it is desirable to form the opening part 8 at this position. And as shown in FIG. 4, the opening part 8 extends to the position of a power supplying point 4.

Figure 5:
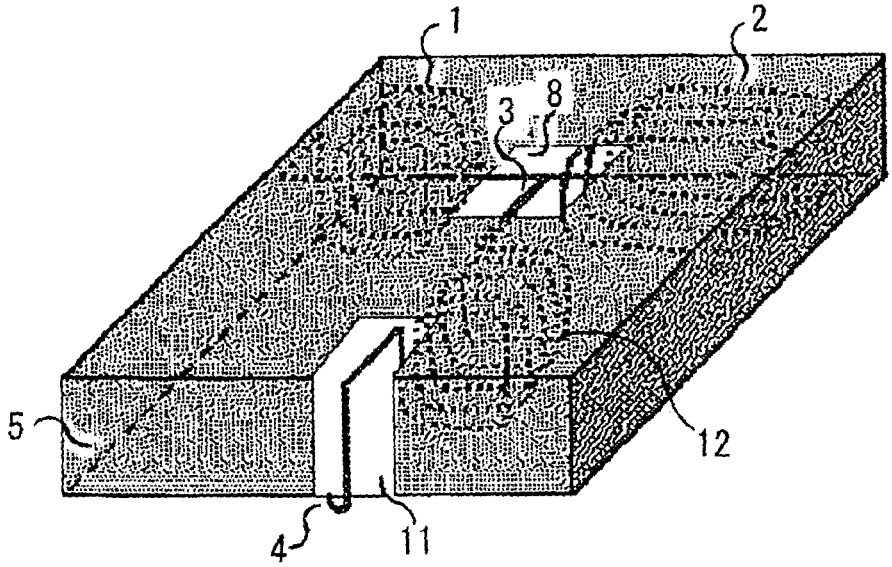
FIG. 5 is a perspective view of an antenna unit at a third embodiment of the present invention.

Next, a third embodiment of the present invention is explained. FIG. 5 is a perspective view of an antenna unit at the third embodiment of the present invention. As shown in FIG. 5, at the third embodiment of the present invention, in addition to the components at the first embodiment, a coil of middle diameter 12 is newly provided in the coil structure. The coil of middle diameter 12 is connected to the joint 3, and an opening part 11 is formed at the position near the power supplying point 4 of the coil of middle diameter 12. And as mentioned at the second embodiment, the opening part 8 is also formed at the position near the joint 3. A current flowing at the power supplying point 4 is relatively large, therefore, this opening part 11 effects to increase the sensitivity.

Next, a radio communication terminal using an antenna unit is explained. As the antenna unit, one of the antenna units explained at the first to third embodiments is used.

Figure 6:
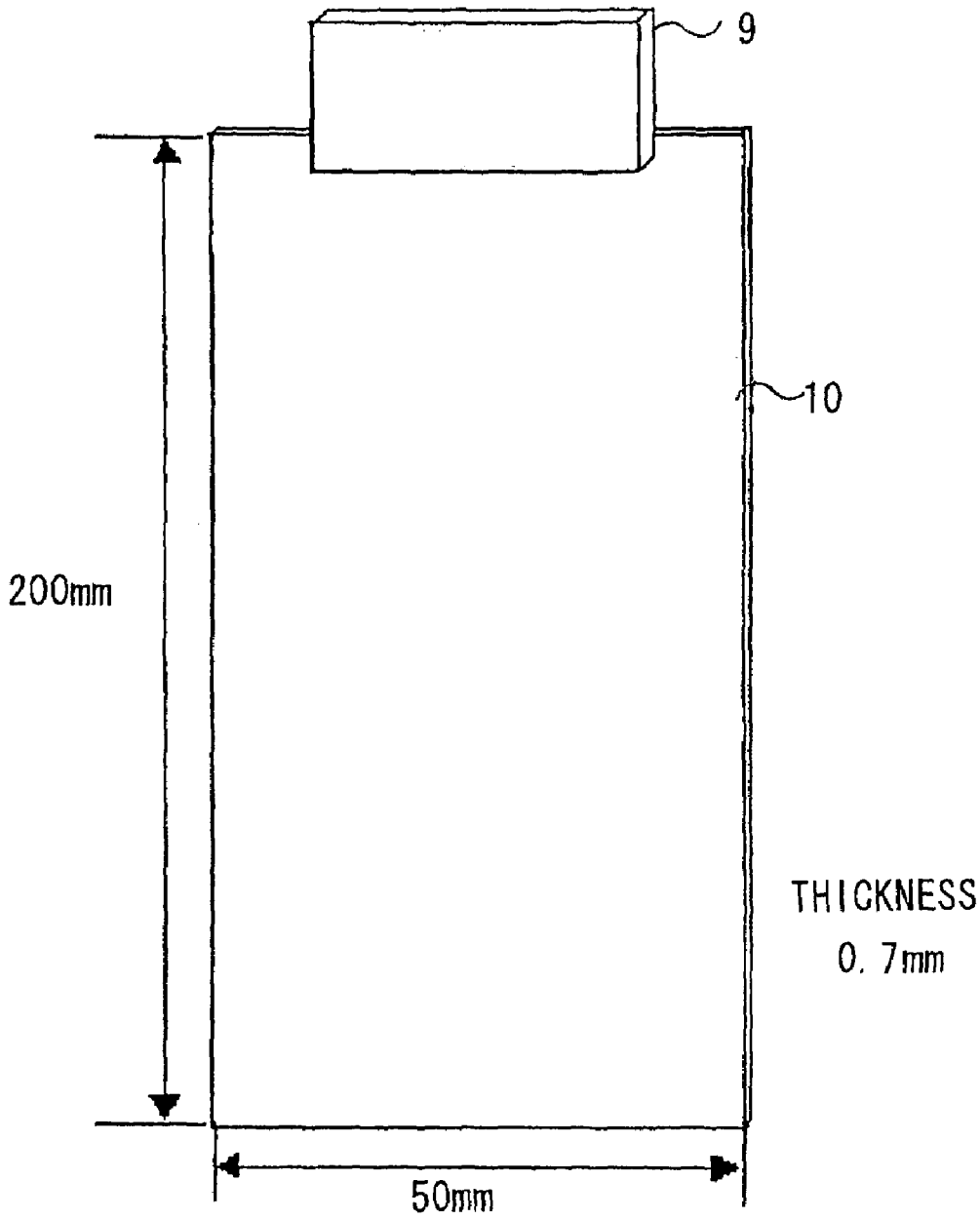
FIG. 6 is a perspective view of a part of a radio communication terminal at an embodiment of the present invention.

FIG. 6 is a perspective view showing a part of a radio communication terminal at an embodiment of the present invention. In FIG. 6, a part, where one of the antenna units at the embodiments of the present invention is assembled in a radio communication terminal, is shown. For example, as the radio communication terminal, a mobile communication terminal is assumed. As shown in FIG. 6, an antenna unit 9 being one of the antenna units explained at the first to third embodiments of the present invention is assembled to a flexible printed circuit board (PCB) 10 of the mobile communication terminal. On the flexible PCB 10, electronic components such as ICs and other components are mounted, and the antenna unit 9 is assembled at the end of the flexible PCB 10.

The size of the flexible PCB 10 is, for example, about 200 mm height, 50 mm width, and 0.7 mm thickness, at a case that the mobile communication terminal is a foldable type. Generally, the position, where the antenna unit 9 is assembled, is the upper end of the flexible PCB 10, at the state that the mobile communication terminal is in speech.

At the second embodiment of the antenna unit of the present invention shown in FIG. 4, the radiation efficiency of radio waves was measured by assembling the antenna unit at a PCB having a copper thin film layer. The measured results are as follows: at a case that the frequency of transmitting radio wave was 880 MHz, the radiation efficiency was increased by 0.9 dB, and at another case that the frequency of transmitting radio wave was 960 MHz, the radiation efficiency was increased by 0.3 dB.

At the embodiments of the present invention, in order to increase the sensitivity in radio wave transmission and radio wave reception, one or plural opening parts were formed in the case 5 of the antenna unit. However, in order to prevent foreign substances such as dust and rain from entering the case 5, a small door can be formed at each of the opening parts. And when the user of the radio communication terminal finds that the sensitivity is low, the user opens the door(s). This structure of the antenna unit is possible.

As mentioned above, according to the embodiments of the present invention, since the antenna unit has one or plural opening parts in its case, therefore, the sensitivity in radio wave transmission and reception can be increased.

While the present invention has been described with reference to the particular illustrative embodiments, it is not to be restricted by those embodiments but only by the appended claims. It is to be appreciated that those skilled in the art can change or modify the embodiments without departing from the scope and spirit of the present invention.

What is claimed is:

1. An antenna unit, comprising:

at least two elements, each of said at least two elements having a coil shape, each coil shape having a diameter different than the other coil shapes; and a case for covering said elements having the coil shape, wherein:

said case has one or plural opening parts within the range keeping the durability of the body of said case.

2. An antenna unit in accordance with claim 1, wherein:

at least one of said plural opening parts is formed in said case at the position near the part where a current flowing in said at least two elements is large.

3. An antenna unit in accordance with claim 1, wherein:

said at least two elements are connected in parallel, and at least one of said opening parts is formed at the position near the part where said at least two elements are joined.

4. An antenna unit in accordance with claim 1, wherein:

at least one of said opening parts is formed at the position near the part where a power supply point to said at least two elements is formed.

5. An antenna unit in accordance with claim 1, wherein:

a door is formed at the position of each of said plural opening parts, and said door is opened when it is required.

6. An antenna unit in accordance with claim 1, wherein:

said case is made of a resin.

7. A radio communication terminal, comprising:

an antenna unit, wherein:

said antenna unit, comprises:

at least two elements, each of said at least two elements having a coil shape, each coil shape having a different diameter than the other coil shapes; and a case for covering said elements having the coil shape, wherein:

said case has one or plural opening parts within the range keeping the durability of the body of said case.

8. A radio communication terminal in accordance with claim 7, wherein:

at least one of said plural opening parts is formed in said case at the position near the part where a current flowing in said at least two elements is large.

9. A radio communication terminal in accordance with claim 7, wherein:

said at least two elements are connected in parallel, and at least one of said opening parts is formed at the position near the part where said at least two elements are joined.

10. A radio communication terminal in accordance with claim 7, wherein:

at least one of said opening parts is formed at the position near the part where a power supply point to said at least two elements is formed.

11. A radio communication terminal in accordance with claim 7, wherein:

a door is formed at the position of each of said plural opening parts, and said door is opened when it is required.

12. A radio communication terminal in accordance with claim 7, wherein:

said case is made of a resin.

13. An antenna unit, comprising:

at least two antenna means, wherein each of the at least two antenna means comprises a coil shape, and wherein each coil shape comprises a diameter different than the other coil shapes; and means for enclosing the at least two antenna means, wherein the enclosing means comprises one or more opening means within the range keeping a durability of a body of the enclosing means.

14. The antenna unit of claim 13, wherein at least one of the opening means is formed in the enclosing means at a position near where a current flowing in the at least two antenna means is large.

15. The antenna unit of claim 13, wherein the at least two antenna means are connected in parallel, and wherein at least one of the opening means is formed at a position near where the at least two antenna means are joined.

16. The antenna unit of claim 13, wherein at least one of the opening means is formed at a position near where a power supply point to the at least two antenna means is formed.

17. The antenna unit of claim 13, wherein a door means is formed at a position of each of the opening means, and wherein the door means is opened when it is required.

18. The antenna unit of claim 13, wherein the enclosing means is comprised of a resin.

* * * * *